United States Patent [19]

Sitzler

[11] 4,327,956

[45] May 4, 1982

[54] LOW INSERTION FORCE DUAL BEAM PIN TERMINAL AND CONNECTOR

[75] Inventor: Fred C. Sitzler, Dillsburg, Pa.

[73] Assignee: E. I. Du Pont de Nemours and Company, Wilmington, Del.

[21] Appl. No.: 126,296

[22] Filed: Mar. 3, 1980

Related U.S. Application Data

[63] Continuation-in-part of Ser. No. 931,521, Aug. 7, 1978, abandoned.

[51] Int. Cl.[3] ..... H01R 4/24; H01R 13/58

[52] U.S. Cl. ..... 339/107; 339/97 R; 339/258 R

[58] Field of Search ..... 339/97 R, 97 P, 99 R, 339/258 R, 258 P, 217 S, 252 R, 256 RS

[56] References Cited

U.S. PATENT DOCUMENTS

| | | | |
|---|---|---|---|
| 3,152,849 | 10/1964 | Deakin | 339/217 S X |
| 3,594,699 | 7/1971 | Jayne et al. | 339/75 |
| 3,646,500 | 2/1972 | Wessely | 339/65 |
| 3,771,917 | 6/1972 | Ammon et al. | 339/17 L |
| 3,944,313 | 3/1976 | McKeown et al. | 339/75 |
| 4,053,197 | 10/1977 | Teagno | 339/217 S X |

FOREIGN PATENT DOCUMENTS

| | | |
|---|---|---|
| 1790199 | 1/1972 | Fed. Rep. of Germany . |
| 2615995 | 10/1976 | Fed. Rep. of Germany . |
| 2827631 | 1/1979 | Fed. Rep. of Germany . |
| 2376604 | 7/1978 | France . |

*Primary Examiner*—Eugene F. Desmond

[57] ABSTRACT

An elongate dual beam electrical terminal and a connector containing a plurality of same. The terminal has a contact at each end. One of the contacts is defined by a pair of longitudinally disposed beams with laterally opposed stand-off tabs which preload the beams to provide for low insertion force interconnection with pin contacts. The connector includes a terminal housing having a plurality of housing cavities which contain the dual beam contact terminals. For use in the connector, the contacts of the terminals opposite the dual beam ends of the terminals are wire insulation displacement contacts. The latter contacts protrude from the housing cavities for electrical interconnection with insulated wires carried on an insulation displacement contact block. The block is mated with the terminal housing, and a strain relief shroud fits over the block and latches to the terminal housing to form the assembled connector.

6 Claims, 6 Drawing Figures

LOW INSERTION FORCE DUAL BEAM PIN TERMINAL AND CONNECTOR

This is a continuation-in-part of my application Ser. No. 931,521 filed Aug. 7, 1978, now abandoned.

DESCRIPTION

TECHNICAL FIELD

This invention relates to microcircuit connectors involving pin terminations, particularly those involving preloaded dual beams. More particularly, this invention relates to the use of elongate dual beam electrical terminals and a connector containing a plurrality of such terminals for mating with pin contacts.

BACKGROUND ART

Beam contacts have been widely used in applications involving circuit board edge connectors and pin connectors. In edge connector applications, many of the available structures have involved the technique of preloading the beams for the purpose of reducing circuit board insertion forces. For example, U.S. Pat. No. 3,464,054 to Mansfield discloses a connector block having contact members pretensioned against a wall for reducing the force of inserting an insulative substrate into an elongated channel. In another example, U.S. Pat. No. 3,671,917 to Ammon discloses a connector housing in which flanges on each of the terminals are held apart by an overhanging lip portion so as to preload the terminals for receiving a male pin contact.

The use of dual beams at one end of a terminal is disclosed in U.S. Pat. No. 3,665,375 to Thoms, et al. Such terminals, as shown in FIGS. 1 and 2 therein, have been used with edge board connectors.

In recent years there has been an increase in the sizes of pin fields in microcircuit applications. This has given rise to a demand for reduced insertion forces in pin connector technology. One usage involves integrally molded elongated plastic ledges in the side walls of the connector housing which preload dual beam terminals by spreading the beams apart when the terminals are inserted into housing cavities. A prime disadvantage of this system, however, is that the beams are easily damaged by the plastic ledges upon insertion into the cavities. In addition, the system does not adequately allow for non-standard pin position. Thus, a poor contact is sometimes obtained when, because the terminal is immobilized by the plastic ledges, the terminal cannot accommodate an off-set or misaligned pin.

DISCLOSURE OF INVENTION

The elongate electrical terminal of this invention has a contact at each end, one of which is a set of dual beams which are spaced apart for receiving a pin contact. Each beam has laterally opposed stand-off tabs extending from its sides toward its opposing counterpart beam. The tabs are symmetrically positioned so that one of two tabs on each beam butts against one of the tabs on the opposing beam to hold the beams in a preloaded position. In this manner, a low insertion force interconnection may be achieved between the beams and a male pin contact.

The connector of this invention houses a plurality of one embodiment of the terminal described. The connector includes a terminal housing which contains a plurality of parallel cavities for holding the terminals. The elongate terminal for use in this connector has an insulation displacement contact at the end opposite the dual beam contact end. The insulation displacement contact portion of each terminal protrudes from its respective terminal cavity for electrical interconnection with an insulated wire. An insulation displacement contact block mates with the terminal housing at the end of the housing from which the insulation displacement contacts protrude. The contact block has parallel slots extending laterally across its mating surface adapted to hold insulated wires for interconnection with the protruding contacts. A strain relief shroud fits over the insulation displacement contact block and latches to the terminal housing to complete the fully assembled connector.

In one end of the terminal housing are apertures for receiving pins which extend from a male pin field. Each aperture includes a lead-in area to one of the cavities inside for prepositioning a pin for interconnection with the dual beams of the terminal contained therein.

The advantages of this connector and its corresponding terminal are numerous. Although the insulation displacement end of the terminal is secured to a wire carried on the insulation displacement contact block, the dual beam end of the terminal is free to float within the housing cavity. Thus, compensation, is automatically made for offset or misaligned pins in the pin field. The latter mechanism also lowers the potential for damage to plated contact surfaces of the beams which is often incurred as a result of such off-positioned pins.

In addition, since each terminal contains its own preloading feature, there is no necessity for cooperation between the terminal and housing projections or other housing parts. Hence, the aforementioned damage experienced by inserting beam terminals into cavities containing plastic ledges is avoided. Moreover, pin surface contamination is also avoided because the pins have no plastic ledges to rub against. Thus, a more reliable contact is achieved, particularly in applications involving repeated withdrawals and insertions.

Finally, more reliable manufacturing conditions are also achieved, since only the terminal tolerance must be controlled, rather than the multiple tolerances of terminal and housing. As a result, the space between the beams and the commensurate preloading forces are closer to desired values.

BRIEF DESCRIPTION OF THE DRAWINGS

For better understanding of the advantages of the present invention, reference will be made to the accompanying drawings in which.

DESCRIPTION OF THE INVENTION

Figure 1:
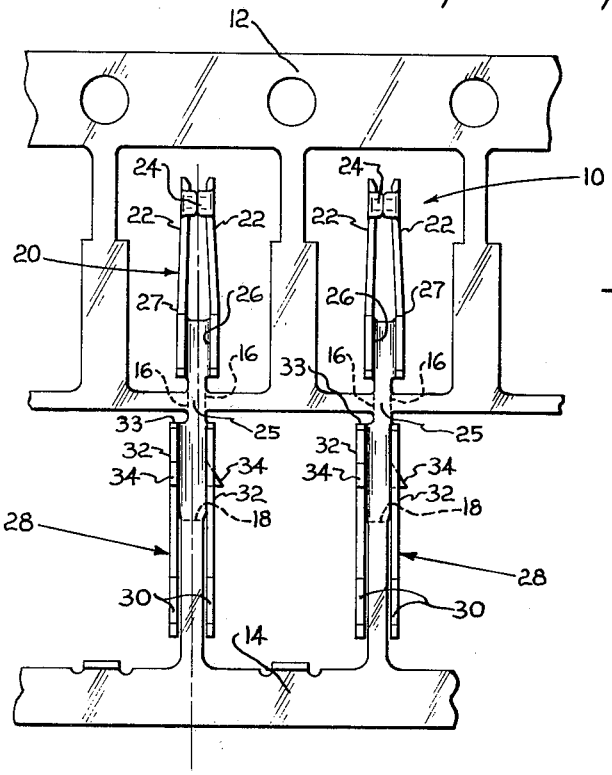
FIG. 1 is an elevation view of two of the terminals of this invention attached to primary and secondary carrier strips.
Figure 2:
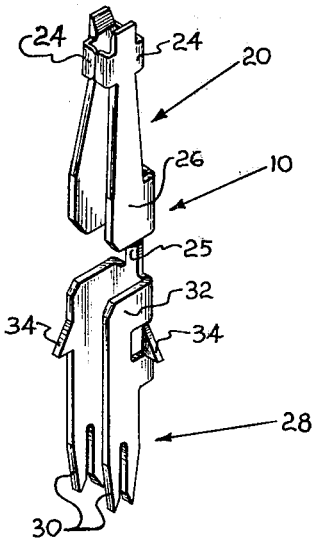
FIG. 2 is a side view of one of the same terminals after detachment from carrier strips.

One embodiment of the dual beam terminal of this invention is depicted in FIGS. 1 and 2. In FIG. 1, two of the terminals 10 are shown attached to primary and secondary carrier strips 12 and 14. The second carrier strip 14 is used for retention of rigidity during manufacturing and plating steps to avoid bending the terminals out of axial alignment. FIG. 2 depicts a side view of one of the terminals after detachment from the carrier strips. The terminal is detached at dotted lines 16 and 18 (FIG. 1) by blanking.

The terminal is elongate and has a dual beam contact 20 at one end and a contact 28 at the other end. For use in the connector of this invention, contact 28 is an IDC contact. The contacts are separated by a neck portion 25 which allows for flexure of the dual beam end relative to the fixed IDC end of the terminal 10 as used in the connector of this invention. The dual beam contact is defined by two opposing spring arms (alternately called beams) 22 which are spaced apart for receiving a male pin contact. Laterally opposed stand-off tabs 24 extend symmetrically from the edges of each beam 22, one of the two tabs on one beam butting against one of the tabs on the opposing beam. The result is that the two beams 22 are spring loaded toward each other, as so held by the tabs, to present a preloaded contact for low insertion force mating with a pin contact. For proper connection, the tabs must spread the beams less than the width of the pin contact to be inserted.

The terminal may be stamped from flat metal sheets of copper nickel alloy, phosphor-bronze, or other suitable electrical conductive material, formed into final shape by successive die steps, then plated with nickel and/or gold (or other desired plating metals). Preferably, the terminal remains attached to the primary and secondary carrier strips throughout both forming and plating steps.

Pre-loading of the beams 22 is achieved during manufacture. The beams extend from segment 26 of the terminal 10. After the stamping but prior to forming, all elements of the terminal 10, including the segment 26, the beams 22 and tabs 24 lie flat in the same plane. The tabs 24 are then bent inwardly 90°, and the beams 22 are bent inwardly 5° to 15° along dotted line 27 toward segment 26. Segment 26 is then formed into a "U", during which the tabs 24 of respective opposing beams come into contact and the beams 22 become elastically deformed, or, as described in the art, pre-loaded.

Figure 3:
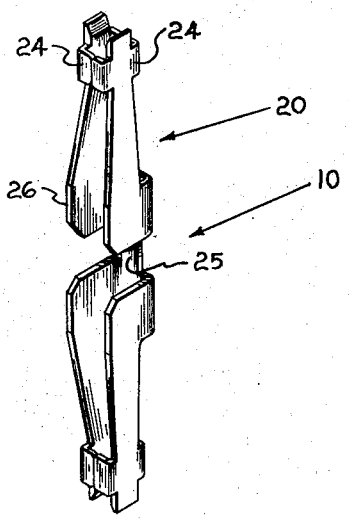
FIGS. 3, 4, and 5 are alternate embodiments of the terminal of this invention.
Figure 4:
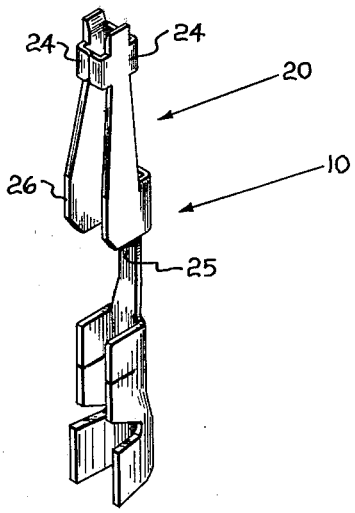
Figure 5:
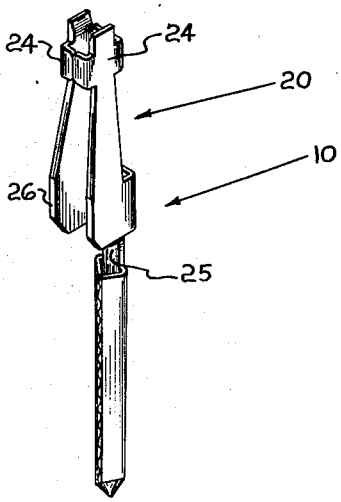

By way of example, the contact 28 of terminal 10 may be either a second dual beam contact, a crimp contact, or a wire wrap tail as shown in FIGS. 3, 4, and 5, respectively. Obviously, other useful contacts are amenable as well. However, for use in the connector of this invention, a redundant insulation displacement contact 28 is provided. The insulation displacement contact (IDC) contains bifurcated tines 30 designed to pierce through insulation to make electrical contact with an insulated wire. The tines 30 extend from a second U-shaped segment 32 of the terminal. The latter segment is conveniently formed into a U at the same time that segment 26 is so formed. Locking detents 34 protrude from segment 32 for securing the terminal in a connector housing cavity as explained hereinafter. It will be noted that in the plane of FIG. 1, the center line of the IDC contact 28 is slightly offset from that of the dual beam contact 20. This configuration provides advantages which relate to the use of the terminal 10 in the connector of this invention, as also explained hereinafter.

Figure 6:
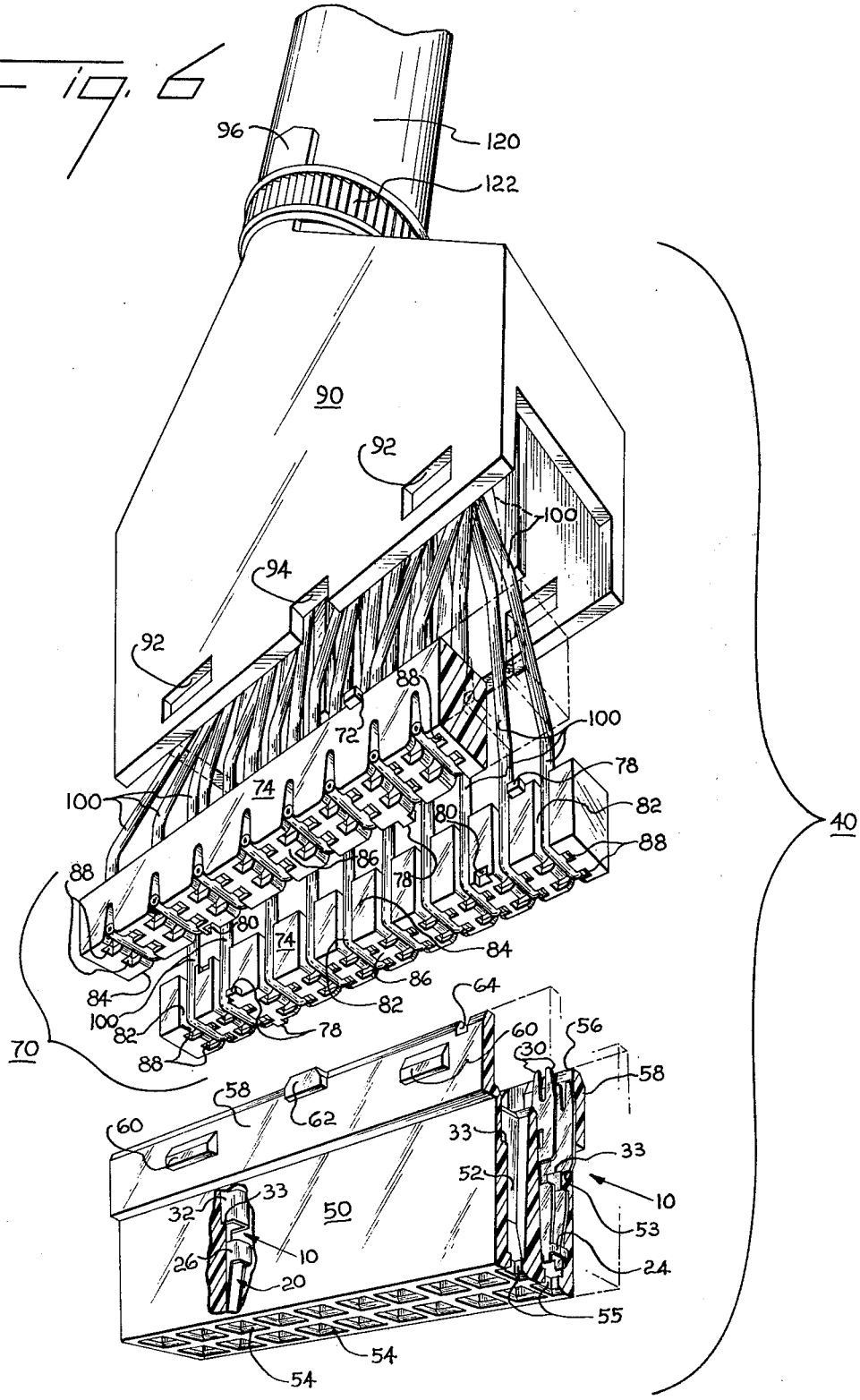
FIG. 6 is an exploded perspective view of the connector of this invention which contains a plurality of the terminals of FIGS. 1 and 2.

The connector of this invention is depicted in FIG. 6. The connector 40 is shown in an exploded perspective view and includes a plurality of the terminals 10 of this invention. The principal connector parts are the terminal housing 50, the insulation displacement contact block 70 (formed in two halves 74), and the strain relief shroud 90.

The terminals 10 are supported in terminal cavities 52 of the terminal housing 50. The housing 50 contains a two-row array of apertures 54 which provide access for male pin contacts (not shown) to mate with the terminals 10 housed in each cavity 52. The apertures have beveled lead-ins 55 which afford easier entry of male pin contacts. The terminals are inserted in the latching end 56 of the housing 50. As mentioned, the center line of the IDC contact 28 is slightly offset from that of the dual beam contact 20 in the terminal plane of FIG. 1. This configuration provides an offset edge 33 of segment 32 which abuts housing wall projection 53. Thus, although the dual beam end of the terminal may be inserted into a cavity 52 without interference with projection 53, the offset edge 33 abuts the projection 53, and thus restrains the terminal from further forward movement. Further securement of the terminal in the cavity is afforded by integral locking detents 34 which extend outwardly from segment 32 to provide an interference fit within the cavity by friction contact with the walls thereof.

The latching end 56 of the terminal housing 50 contains extensions 58 with integral latching nubs 60, polarity nub 62 and polarity notch 64. The latching nubs 60 cooperate with corresponding latching cavities 92 in the strain relief shroud 90 to hold the connector assembly mated. The polarity nub 62 cooperates with polarity notch 94 in the strain relief shroud 90 to ensure that the connector will assemble in only one way, for achievement of proper electrical polarity. The polarity notch 64 on the housing 50 cooperates with the polarity nub 72 shown on the IDC half block 74 for the same purpose.

The IDC block 70 is formed of two identical half blocks 74. These half blocks fit together in hermaphroditic fashion via nubs 78 and cavities 80 contained thereon. Prior to fitting the halves together, insulated wire 100 is inserted into wire slots 82 in block halves 74. The wire slots extend laterally over the inner faces 84 of both halves 74 and continue around over the contact faces 86 of both halves. The portions of each wire slot 82 which extend over the contact faces 86 are intersected by longitudinally disposed IDC receiving slots 88 which provide spaces which receive the bifurcated tines 30 of terminals 10 upon the mating of the IDC block 70 with the terminal housing 50. The act of mating the latter connector parts involves the severing of insulation on wires 100 by the bifurcated tines 30. Upon the severing of insulation, physical contact of the metal wire is made with the metal tines 30 for electrical interconnection.

In FIG. 6, it will be noted that the lateral position of the terminal 10 in the top row of cavities is reversed 180° from that of the terminal 10 in the bottom row. This represents the best mode for housing the terminals for two reasons. First, the use of hermaphrodictic half blocks 74 is made possible, thus requiring only one mold for making both halves. Second, both of the projections 53 can be positioned on the external walls of housing 50 rather than one of them having to be in the internal wall separating the cavity rows. The latter consideration becomes important when the distance between pin centers becomes small, e.g., 0.125 inch.

The wires 100, as utilized herein, extend from the cable 120. A strain relief shroud 90 is used to provide cable-to-housing securement for avoiding wire strain otherwise created by tensile forces on the cable 120. The shroud 90 fits over the IDC block 70 and latches to the terminal housing 50 by the means described, after the IDC block has been mated with the housing. A cable tie 122 (preferably made of nylon) is then used to band the shroud to the cable. The shroud 90 includes an integral tab 96 which extends over a portion of the cable periphery. The tie 122 is positioned over the tab 96 and is tightened around the cable.

INDUSTRIAL APPLICABILITY

The dual beam terminal of the invention and the connector which utilizes one embodiment of the terminal can both be used in a myriad of microcircuit applications. The terminal may include either a crimp contact, a pin tail, a wire wrap tail, etc. It is amenable to use where pin contacts are used in achievement of electrical terminations, such as circuit boards and pin connectors. The connector is useful in various applications involving IDC contacts which terminate to pin fields. One example of the latter would be in telephonic signal systems.

I claim:

1. An elongate electrical terminal stamped from flat metal sheet, said terminal being formed to have a contact at each end, one of said contacts comprising a pair of longitudinally disposed dual beams for receiving a male pin contact with two laterally opposed stand-off tabs positioned, one on each edge of each of the two beams, one tab on one beam butting against one tab on the opposing beam, said stand-off tabs being formed by bending the tabs inwardly 90° from the flat metal sheet after the terminal has been stamped, said formed tabs holding said beams in a spring-loaded, preloaded position with respect to each other in the fully formed terminal.

2. The terminal of claim 1 wherein the contact at the end opposite the dual beam contact is a wire insulation displacement contact.

3. The terminal of claim 2 wherein the insulation displacement contact is offset in one terminal plane from the dual beam contact.

4. A connector which comprises a terminal housing having a plurality of terminal cavities with elongate electrical terminals contained therein, each terminal being stamped from a flat metal sheet, said terminal being formed to have a contact at each end, one of said contacts comprising a pair of longitudinally disposed dual beams for receiving a male pin contact with two laterally opposed stand-off tabs positioned one on each edge of each of the two beams one tab on one beam butting against one tab on the opposing beam, said stand-off tabs being formed by bending the tabs inwardly 90° from the flat metal sheet after the terminal has been stamped, said formed tabs holding said beams in a spring-loaded, preloaded position with respect to each other in the fully formed terminal for low insertion force interconnection with a male contact.

5. A connector which comprises:

a. a terminal housing having a plurality of terminal cavities with elongate electrical terminals contained therein, each terminal having a contact at each end, one of said contacts comprising a pair of longitudinally disposed dual beams with laterally opposed stand-off tabs which preload the beams for low insertion force interconnection with a male contact, the other contact being a wire-insulation displacement contact which protrudes from the terminal cavity;

b. an insulation displacement contact block formed of two half blocks which are fitted together and which mate with the terminal housing at the end from which the insulation-displacement contacts protrude, said half blocks having parallel slots extending laterally across the mating surfaces thereon, said half blocks having means for receiving insulated wire for lateral insertion in said slots; and c. a strain relief shroud which fits over the insulation-displacement contact block and latches to the terminal housing, the shroud including means for the banding of said shroud to a wire cable.

6. The connector of claim 5 wherein the insulation displacement contact of the terminal is offset in one plane from the dual beam contact thereof and wherein said half blocks are hermaphroditic .

* * * * *